United States Patent [19]

Mingolla et al.

[11] 4,271,555

[45] Jun. 9, 1981

[54] REINFORCED CONCRETE BRIDGE DECKING AND METHOD OF MAKING SAME

[76] Inventors: Joseph Mingolla, P.O. Box 112, Millbury, Mass. 01527; John B. Stubbings, 402 Mass. Ave., Cambridge, Mass. 02139

[21] Appl. No.: 20,472

[22] Filed: Mar. 14, 1979

[51] Int. Cl.[3] ..... E01D 19/12

[52] U.S. Cl. ..... 14/73; 404/19; 404/73; 404/37; 404/45; 14/6

[58] Field of Search ..... 14/73, 6; 404/17, 19, 404/72, 37, 20, 34, 73; 52/174, 319, 578, 660

[56] References Cited

U.S. PATENT DOCUMENTS

| | | | |
|---|---|---|---|
| 1,725,410 | 8/1929 | Muchnic . | |
| 1,725,411 | 8/1929 | Muchnic . | |
| 1,799,313 | 4/1931 | Paulson . | |
| 1,897,327 | 2/1933 | Olson . | |
| 1,955,877 | 4/1934 | Finefrock . | |
| 2,081,352 | 5/1937 | Brown . | |
| 2,093,108 | 9/1937 | Davis . | |
| 2,096,338 | 4/1937 | Greely . | |
| 2,192,970 | 3/1940 | Groth . | |
| 2,308,943 | 1/1943 | Tietig | 14/73 |
| 2,460,330 | 2/1949 | Baccaro . | |
| 2,471,167 | 5/1949 | Oxenrider . | |
| 2,828,080 | 3/1958 | Rennels | 404/34 X |
| 3,024,711 | 3/1962 | Madison . | |
| 3,082,489 | 3/1963 | Douglas . | |
| 3,178,026 | 4/1965 | Christy . | |
| 3,180,460 | 4/1965 | Liskey . | |
| 3,308,725 | 3/1967 | Nagin | 14/73 X |
| 3,317,137 | 5/1967 | Harmon . | |
| 3,491,499 | 1/1970 | Dyer . | |
| 3,643,864 | 2/1972 | Ziegler . | |
| 3,712,187 | 1/1973 | Stelling | 404/34 X |
| 3,825,184 | 7/1974 | Hartl . | |
| 3,842,552 | 10/1974 | Hudson | 14/73 X |
| 4,145,153 | 3/1979 | Fasullo | 404/73 |

*Primary Examiner*—Nile C. Byers, Jr.
*Attorney, Agent, or Firm*—Browdy and Neimark

[57] ABSTRACT

Reinforced concrete bridge decking comprises a plurality of substantially identical, removable, interchangeable reinforced concrete panels having protruding tongues at opposite ends supported on and retained in place by resilient, shock absorbing pads. The panels each have a metallic frame substantially filled with concrete, and an abrasive material layer is bonded on the top surface of the concrete. The abrasive material layer provides a hard, salt resistant, anti-skid surface on the concrete panels, and also serves to strengthen the panels. The resilient pads are readily removable to release the individual panels, so that a tool can be engaged with the panels in the spaces defined between the tongues at the opposite ends thereof to remove the individual panels for maintenance or repair, or to interchange the panels with one another.

18 Claims, 12 Drawing Figures

FIG. 5-A

REINFORCED CONCRETE BRIDGE DECKING AND METHOD OF MAKING SAME

BACKGROUND OF THE INVENTION

This invention relates generally to reinforced concrete slabs or panels, and more particularly, relates to a structure such as bridge decks, piers, runways, sidewalks, ramps, loading docks, and the like, using such panels.

Reinforced concrete building panels are known in the prior art, and in fact, are used in the construction of bridge decking and the like. However, prior art concrete panels are typically secured in place with fastening means such as bolts or the like. This results in at least two disadvantages, i.e., the fastening means engaged between the concrete panel and a supporting surface provides a rigid connection and produces a stress point under dynamic load conditions tending to produce stress cracks in the concrete panel, and the fastening means requires substantial care and effort both in attaching the panels to support structure and in removing the panels therefrom. In fact, with prior art constructions it is frequently necessary to destroy the concrete panels in order to remove them for maintenance or repair or inspection of the bridge subdecking and the like.

Thus, with prior art constructions, the concrete panels are generally secured in place and left there until it is absolutely necessary to tear them up for replacement, or service of the underlying subdecking. Accordingly, those panels situated where most of the traffic occurs over the surface are subjected to more rapid wear than the remaining panels, and more frequent repair of the surface is required. Further, prior art bridge constructions and methods usually require several days to complete installation of the reinforced concrete panels, thereby increasing the cost and inconvenience to the public.

Examples of some prior art structures are shown in the following U.S. patents:

| | | | |
|---|---|---|---|
| 1,799,313 | Paulson et al | 3,024,711 | Madison |
| 1,897,327 | Olson | 3,082,489 | Douglas |
| 1,955,877 | Finefrock et al | 3,178,026 | Christy |
| 2,093,108 | Davis | 3,180,460 | Liskey |
| 2,192,970 | Groth | 3,491,499 | Dyer |
| 2,460,330 | Baccaro | | |

Generally, all of these patents show the use of concrete slabs for various building purposes and they disclose various interlocking and support means. However, some of the panels are not reinforced and others have grooved surfaces. Moreover, none of the panels disclosed in these patents are capable of easy removal and installation in comparison with the present invention.

SUMMARY OF THE INVENTION

The present invention provides a reinforced concrete panel having a metal frame in which the concrete is cast and which defines a pair of spaced apart, longitudinally protruding tongues at opposite ends of the panel. The panels are supported on a plurality of spaced apart, parallel rails secured to a suitable framework or bridge subdecking, and resilient bearing pads are engaged between the rails and projecting tongues of the panels to resilently support the panels on the rails. A plurality of resilient locking wedges are inserted between the projecting tongues and the head of the rails to resiliently lock and retain the panels in place on the bearing pads. By this construction, there are no direct rigid connections between the panels and supporting rails and thus the resilient bearing pads and locking wedges serve as shock absorbing expansion joints. This eliminates any problems which may have heretofore existed with regard to stress cracking produced by rigid fastening means or connectors. Additionally, the locking wedges may be readily removed and the panels then simply lifted from between the rails for repair or maintenance of the panels or bridge subdecking. For that matter, the panels are all substantially identical in construction and size and may thus be interchanged with one another to rotate panels from relatively unused parts of the deck to heavily trafficked areas to thus prolong the life of the decking.

Moreover, each panel has a relatively thin layer of very hard abrasive material on the top surface thereof which is resistant to environmental conditions and which also provides an anti-skid surface and which significantly increases the strength of the concrete panel.

Therefore, bridge decking, or piers, ramps and the like may be readily constructed by securing conventional railroad rails at suitable spaced intervals on substructure and thereafter placing the resilient bearing pads on the foot flange of the rails, after which a panel is simply placed in position and supported on the bearing pads at opposite ends of the panel on a pair of adjacent spaced apart rails. Following this, the locking wedges are inserted between the top of the tongues at the opposite ends of the panel and the head or top flange of the rails thereby locking the panels in place. With this method, a bridge decking may be constructed in a matter of hours rather than days or even weeks as is sometimes encountered in the prior art.

OBJECTS OF THE INVENTION

Accordingly, it is an object of this invention to overcome disadvantages of the prior art, such as indicated above; and it is a further object to provide for improved bridge decking or the like.

It is another object of the invention to provide a reinforced concrete panel having projecting tongues at the opposite ends thereof, cooperable with resilient bearing and locking wedges or pads to resiliently support and secure the panel relative to a framework, whereby the panel may be easily installed and removed and the resilient bearing and locking pads serve as both expansion joints and shock absorbers.

Another object of the invention is to provide a reinforced concrete panel having a very hard, abrasive surface layer providing an anti-skid surface and also significantly increasing the strength of the concrete panel.

A further object of the invention is to provide decking for a bridge, pier, loading dock and the like wherein the decking comprises a plurality of generally parallel spaced apart frame members or rails with a plurality of substantially identical, rectangularly shaped concrete panels supported on and spanning the distance between adjacent rails, and wherein the panels are supported on and secured to the rails by means of resilient bearing pads and resilient locking wedges engaged between opposite ends of the panels and the rails, thereby facilitating installation and removal of the panels and eliminating the need for separate fasteners such as bolts and the like.

A still further object of the invention is the method of constructing decking by securing in place a plurality of spaced apart, generally parallel rails, placing resilient bearing pads on foot flanges of the rails, positioning and supporting a plurality of concrete panels on the resilient bearing pads, and inserting resilient locking wedges between the panels and rails to lock the panels in place, whereby the panels may be easily and quickly installed and removed for repair or maintenance of the bridge or inspection of the bridge subdecking or interchanging of the panels with one another to prolong the life of the decking.

BRIEF DESCRIPTION OF THE DRAWINGS

FIG. 5 and 5A is a greatly enlarged view in section taken along line 5—5 in FIG. 3.

DETAILED DESCRIPTION OF THE PREFERRED EMBODIMENT

Figures 1, 11:
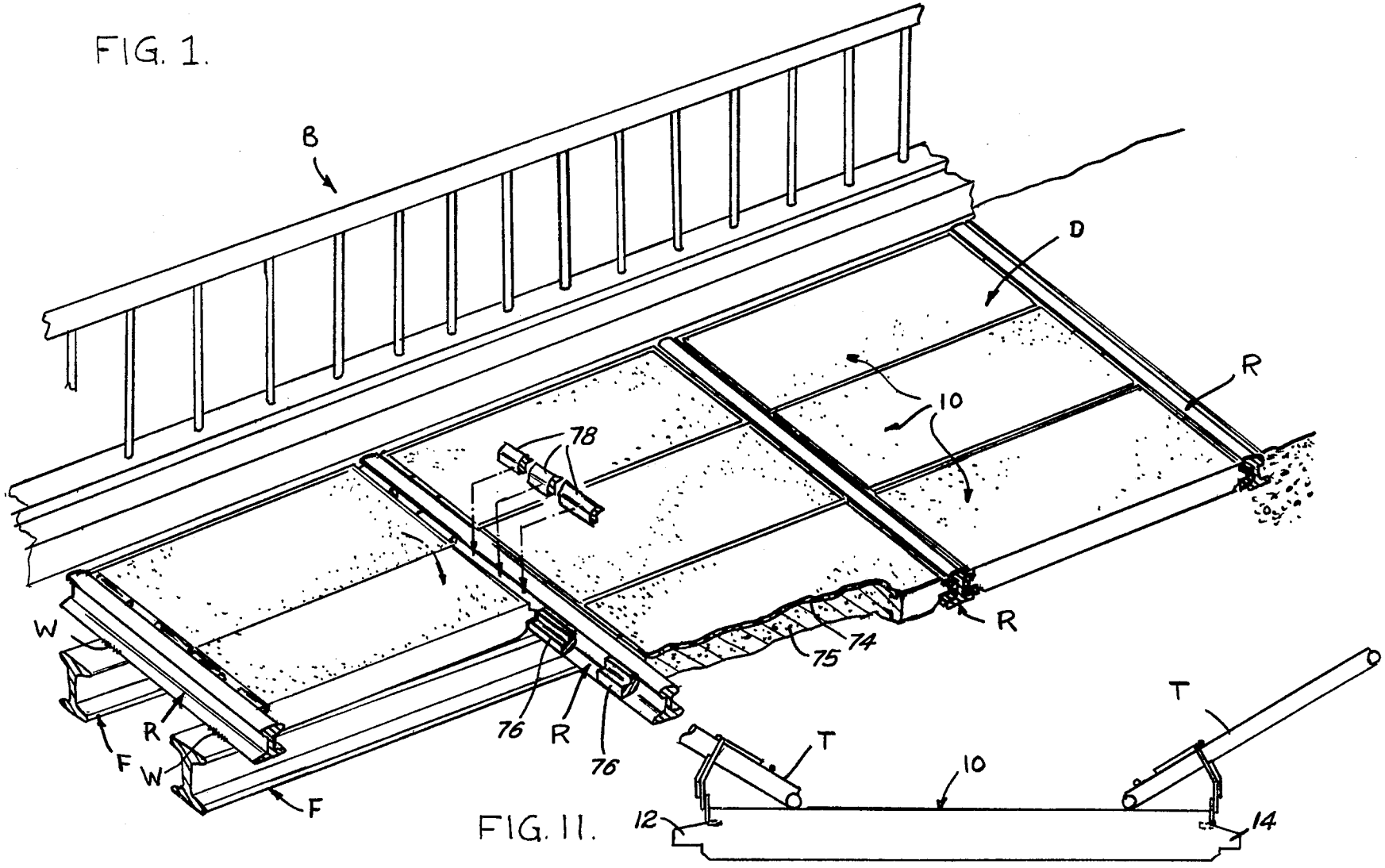
FIG. 1 is a fragmentary top perspective view of a portion of a bridge decking constructed in accordance with the invention and showing the manner of placement of resilient bearing pads, concrete panels, and resilient locking wedges on the support rails.
FIG. 11 is a somewhat diagramatic view illustrating the manner in which a pair of tools are engaged with a panel according to the invention in order to lift and carry the panel.
Figure 4:
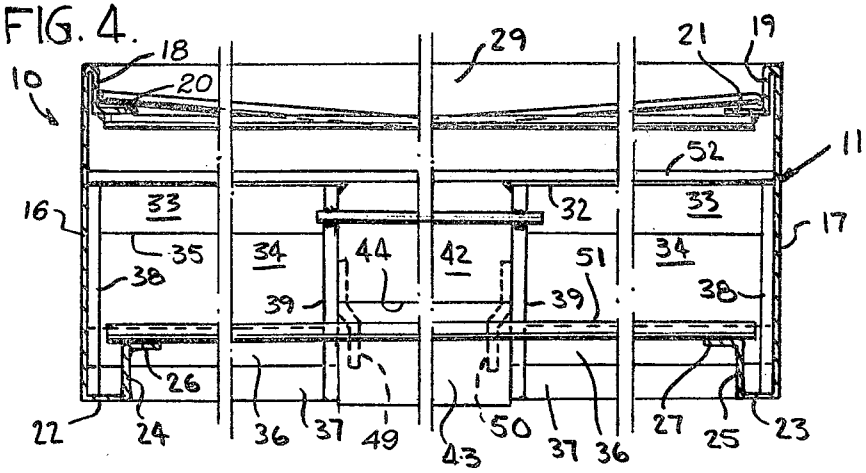
FIG. 4 is an enlarged view in section taken along line 4—4 in FIG. 3.

In the drawings, wherein like reference numerals indicate like parts throughout the several views, a bridge utilizing panels in accordance with the invention is indicated generally at B in FIG. 1. The bridge decking D comprises a plurality of substantially identical, rectangularly shaped, reinforced concrete panels 10 supported on spaced apart, generally parallel rails R which are supported, in turn, on bridge subdecking or framework F, shown as comprising I-beams. With this structure, the rails R are welded to the I-beams as at W, or if desired, the rails may be bolted or otherwise suitably secured to the I-beams. If concrete bridge subdecking is used in the bridge structure, suitable fastening means may be cast in the concrete subdecking and the rails R affixed thereto as by bolts or welds or the like. The rails R may be of any suitable structure, as for example, 115 lb. A.R.E.A. (American Railway Engineering Association).

Each panel 10 comprises a generally rectangular frame 11 having a pair of protruding, spaced apart tongues 12 and 13 at one end and a similar pair of protruding, spaced apart tongues 14 and 15 at the other end. The frame has a pair of parallel, longitudinally extending sidewalls 16 and 17 having their upper edges turned downwardly as at 18 and 19, respectively, and then bent inwardly toward the opposite sidewall to define a horizontal flange as at 20 and 21, respectively. Similarly, the bottom edges of the sidewalls are first bent inwardly as at 22 and 23, respectively, and then upwardly as at 24 and 25, respectively, and thence inwardly toward the opposite wall as at 26 and 27, respectively, to define horizontal flanges.

The opposite ends of the panel comprise end wall members 28 and 29, each having substantially an L shape in transverse cross-section and extending completely across the width of the panel at the top thereof, with the horizontal portion of each end wall member 28 and 29 extending generally horizontally inwardly toward the opposite end of the panel, as at 30 and 31, respectively.

Figure 9:
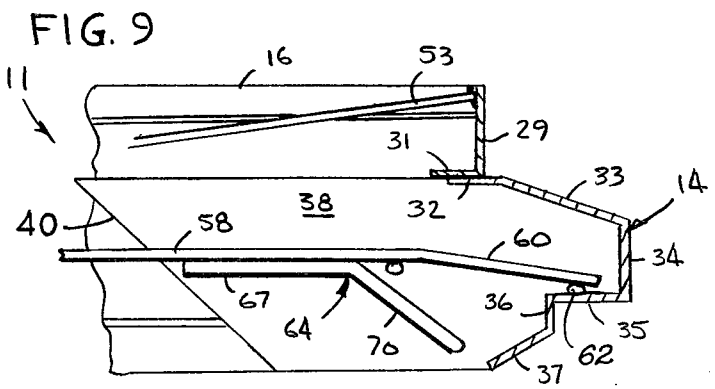
FIG. 9 is an enlarged fragmentary view in longitudinal section taken through one of the protruding tongues of the panel of the invention prior to pouring concrete therein.

Each tongue is formed by a horizontally extending flange portion 32, as seen in FIG. 9, extending contiguous to and parallel with the horizontal portion 30 or 31 of the respective end walls 28 and 29. The horizontal portion 32 of the tongues is joined with a downwardly sloping upper wall 33 which terminates at its forward end in a generally vertically extending forward wall 34. The forward wall 34 is connected at its lower end with a rearwardly extending, horizontal bottom wall 35 which terminates at its rearward end in a relatively short, downwardly projecting wall or shoulder 36 which is, in turn, joined with a rearward and downwardly sloping bottom wall 37 which terminates approximately in the plane of the bottom of the panel. Additionally, each tongue structure includes a pair of substantially identically shaped sidewalls 38 and 39 having their forward ends shaped complementary to the cross-sectional configuration of the tongue, and having a downwardly and forwardly sloping rear edge at 40.

Figure 10:
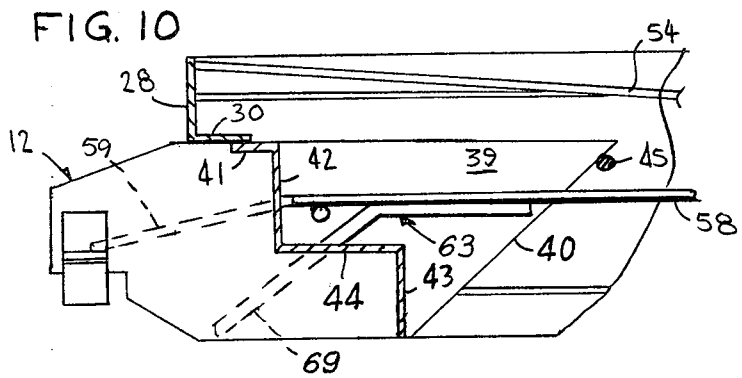
FIG. 10 is a view similar to FIG. 9, but with the longitudinal sectional view taken in the area between the protruding tongues at one end of the panel.

The end wall of the panel in the space between the protruding tongues is defined by a generally horizontal flange 41 contiguous with and parallel to the horizontally extending portions 30 and 31 of the upper end wall members 28 and 29, joined to the upper end of a stepped configuration comprising a pair of generally vertical riser portions 42 and 43 connected by a horizontal portion 44. See FIG. 10.

Relatively short, laterally extending braces 45 and 46 are secured to the underside of the sloping rear edges 40 of the inner, adjacent walls 39 of the tongues. Further, a plurality of brackets 47, 48, 49 and 50 are secured to the inner facing surfaces of the tongues at opposite ends of the panel to serve as stops for the resilient bearing pads or as tool engaging members or the like, as desired. In other words, during use, the tongues are supported on bearing pads but the space between the tongues at opposite ends of the panel is left free of any bearing pad.

Additional bracing for the frame comprises a plurality of laterally extending reinforcing bars or the like 51 extending laterally across the panel and welded to the horizontal flanges 26 and 27 of the opposite sidewalls 16 and 17. A further plurality of laterally extending braces 52 extends across the panel near the top thereof. Diagonally extending braces 53 and 54 extend between opposite corners of the panel to impart torsional rigidity thereto.

The wall members of the frame may comprise galvanized steel or aluminum or other suitable material, and preferably have a wall thickness of approximately 3/64 of an inch, although other materials and dimensions may be utilized if desired or necessary.

Figure 6:
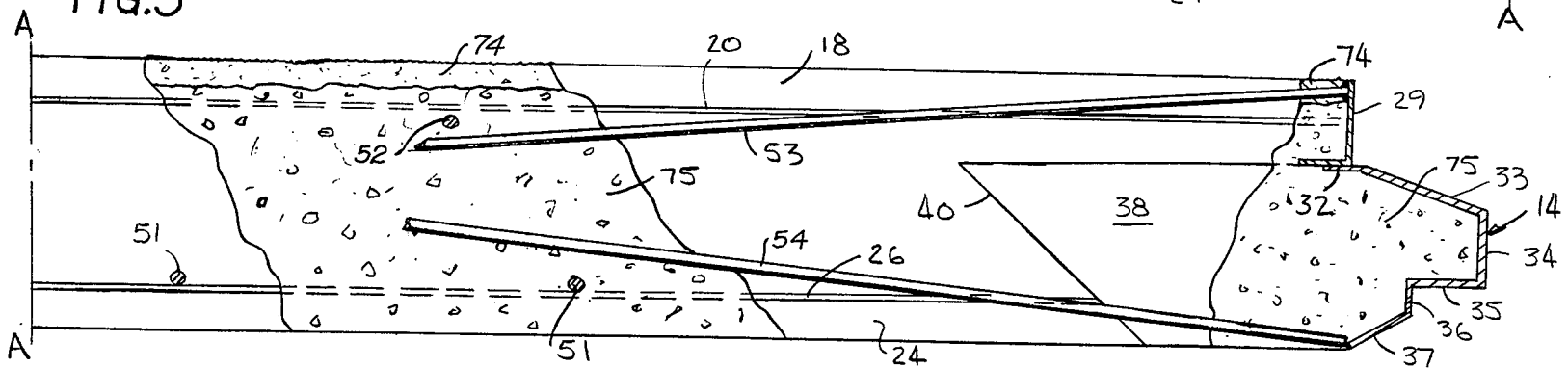
FIG. 6 is a plan view of a reinforcing structure used in the concrete panel of the invention.
Figure 6:
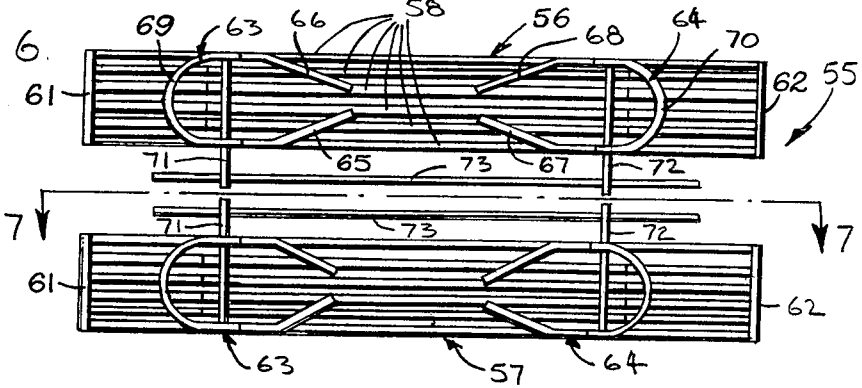
Figure 7:
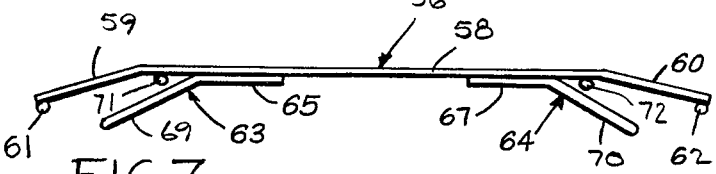
FIG. 7 is a view in section taken along line 7—7 in FIG. 6.
Figure 8:
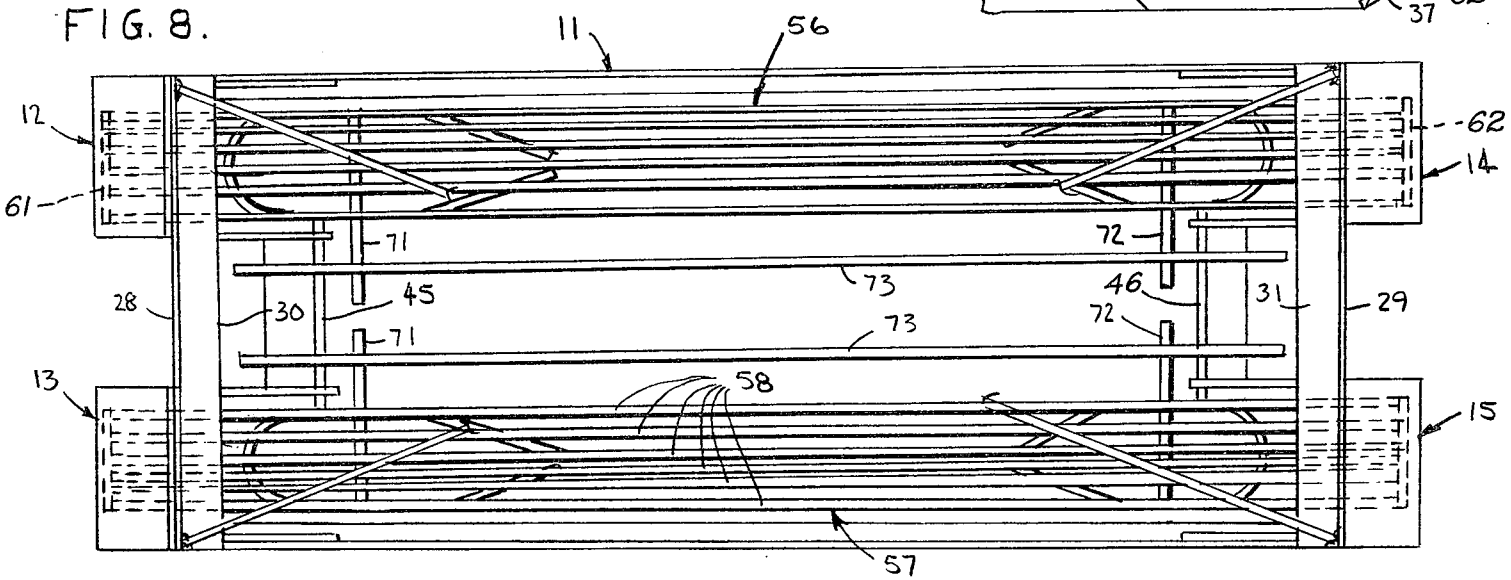
FIG. 8 is a plan view similar to FIG. 3, with the reinforcement of FIG. 6 shown in place in the frame.

A reinforcing cage 55 is also positioned within the frame prior to the time concrete is poured therein, and as seen best in FIGS. 6, 7 and 8, the cage 55 comprises a pair of substantially identical reinforcing structures 56 and 57, each comprising a plurality (shown here as 6) of longitudinally extending reinforcing bars 58 bent downwardly at their opposite ends 59 and 60 and joined by relatively short, laterally extending bars 61 and 62 welded to the ends 59 and 60 on the lower surfaces thereof. Additionally, a pair of generally horseshoe-shaped members 63 and 64 are welded to the underside of each reinforcing cage member 56 and 57, and the horseshoe-shaped members 63 and 64 have inwardly converging legs 65, 66 and 67, 68 joined with curved portions 69 and 70, respectively, deflected downwardly at an angle slightly steeper than the angle of deflection of the ends 59 and 60 of the reinforcing bars 58.

A second pair of laterally extending reinforcing bars 71 and 72 is welded to the underside of the reinforcing cage members 56 and 57 in the area between the horseshoe-shaped members 63 and 64 and the downturned ends 59 and 60 of the bars 58, and these laterally extending members 71 and 72 project inwardly beyond the longitudinally extending bars 58 and have a longitudinally extending, elongate reinforcing bar 73 welded thereto in generally parallel relationship to the bars 58.

The reinforcing bars may be of any suitable size, but in the example shown, are preferably size #4 rebar.

Further, a typical panel constructed in accordance with the invention may have a length of approximately 60 inches, a width of approximately 24 inches, and a height or thickness of approximately 5 inches, although any other suitable dimensions may be utilized depending upon the requirements of the particular construction.

The frame with reinforcement 55 secured therein by tie wires is placed in an inverted position upon a worktable which has been previously treated with a retarding agent, and a calcined bauxite mix is then poured into the frame to form a layer 74 having a depth of approximately ¾ of an inch. The mass is vibrated to remove entrapped air and is allowed to stand until it has achieved a stiff consistency. In a preferred construction, the calcined bauxite mix is made up with the ingredients and in the proportions as follows:

| | |
|---|---|
| Bauxite and Sand to Cement | = 3.7/1 |
| Water to Cement | = 0.58/1 |
| Bauxite to Sand | = 17/3. |

The particle size of the bauxite is preferably of ¼ inch mesh and dust.

Concrete is then poured into the frame, filling the frame, and the concrete forms a bond with the calcined bauxite layer previously poured. The concrete preferably has an aggregate to cement ratio of 4.7/1 and a water to cement ratio of 0.27/1. The concrete mass 75 is then vibrated to remove any entrapped air. After the concrete mix has set and hardened, the frame is removed from the casting table, turned over, and the anti-skid layer 74 of calcined bauxite lightly brushed to expose the anti-skid material therein. The layer 74 has superior resistance to road salt.

The proportions of ingredients in the calcined bauxite mix may be varied plus or minus 5% without loss of optimum performance.

When the concrete and calcined bauxite mix have cured, the panel is ready for use.

Figure 2:
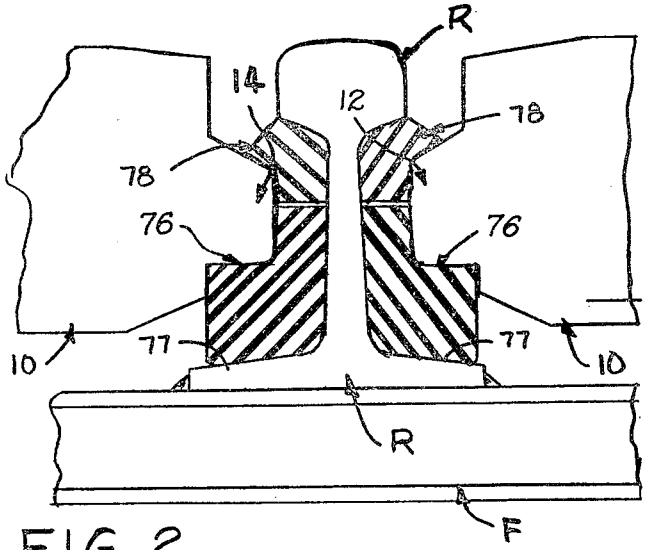
FIG. 2 is a greatly enlarged, fragmentary view in section showing the manner of attachment between the panels and the supporting rails by use of the resilient bearing pads and resilient locking wedges.
Figure 3:
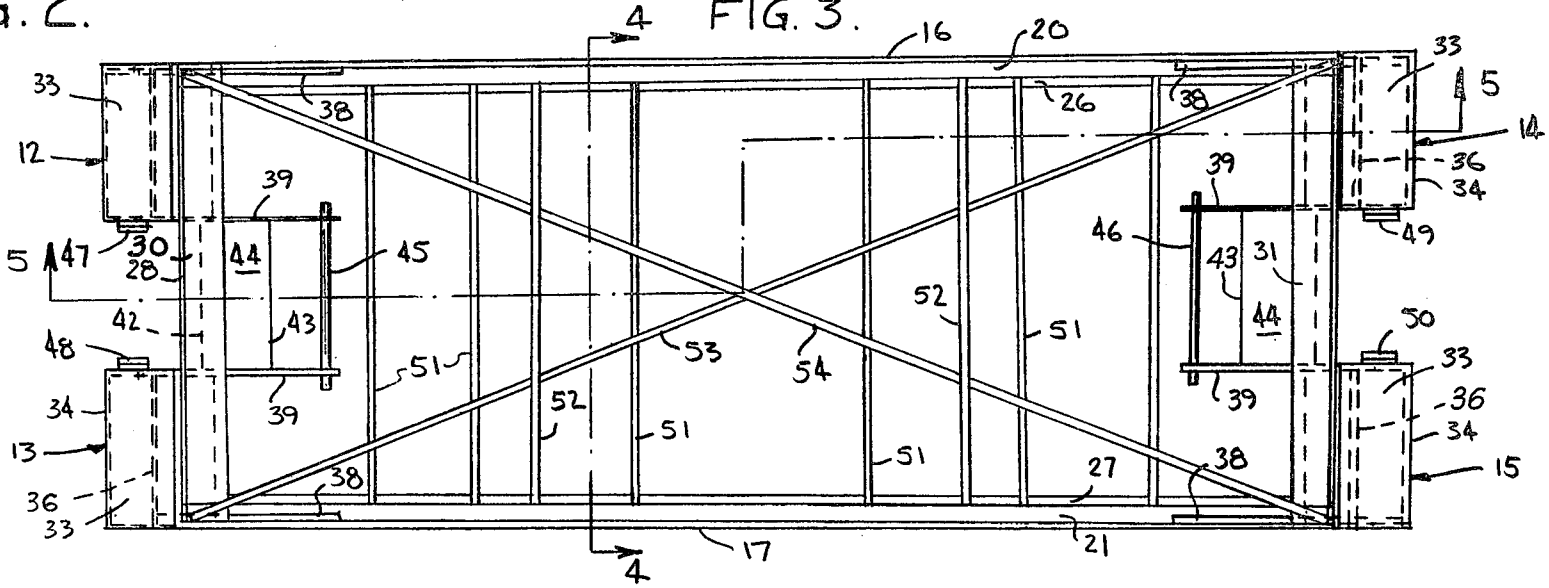
FIG. 3 is a plan view of a frame used in manufacturing one of the panels of the invention.
Figure 5:
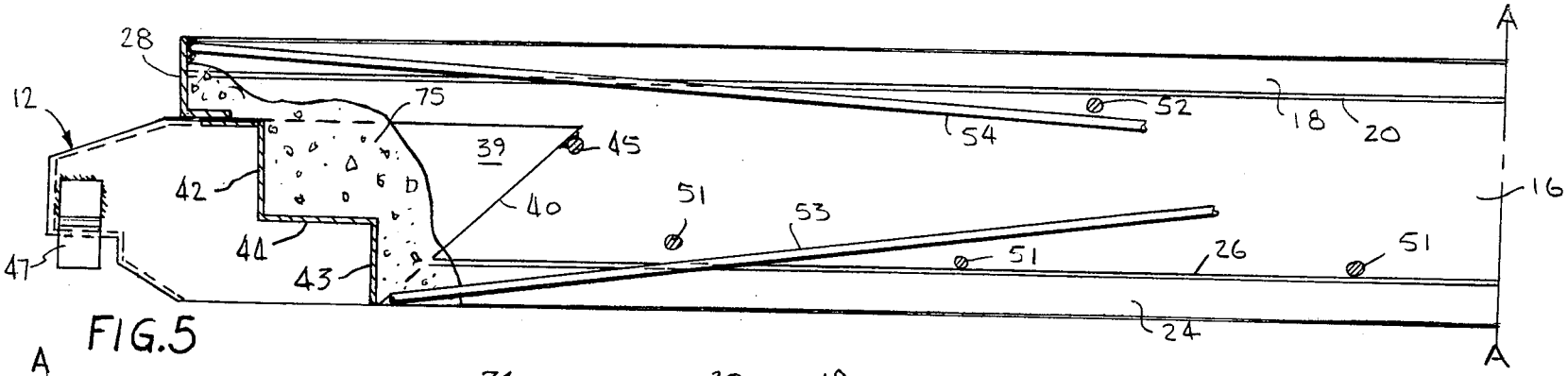

As seen in FIGS. 1 and 2, and as discussed previously herein, a plurality of rails R are secured on a substructure, shown in FIG. 1 as I-beams F, and bearing pads 76 are placed upon the foot flanges 77 of the rails R. As seen best in FIG. 2, the bearing pads 76 are generally L-shaped in cross-sectional configuration and are placed at spaced apart intervals upon the foot flanges 77 of the rails, such that when a panel 10 is supported thereon the space between the tongues at the end of the panel does not have a bearing pad thereunder.

After a panel is supported on the bearing pads 76 at opposite ends thereof on a pair of parallel, adjacent rails R, resilient locking wedges 78 are inserted between the tops of the tongues 12 and 14 and the head of the rail R to retain the panel in place. Thus, as seen best in FIG. 2, the panels are supported completely by the resilient bearing pads and locking wedges and there is no direct rigid engagement or connection between the panels and any of the subdecking or bridge support structure.

In order to remove a panel for repair or maintenance, or for inspection or repair of the underlying subdecking, the locking wedges 78 are simply slid endwise from between the top of the tongue and the head of the rail and the panel is then lifted out by use of a tool such as that indicated at T in FIG. 11.

The bearing pads and locking wedges may be formed of any suitable material resistant to road salt. Elastomers such as commercially available hard synthetic rubber formulations may be used. The rubber pads also serve as expansion joints, as well as means to lock the concrete panels securely in place.

Thus, in accordance with the present invention, a simple and economical reinforced concrete panel is provided which is exceptionally strong and durable and which has a very effective anti-skid surface, even when wetted, and which, moreover, adds significantly to the strength of the concrete panel. The use of resilient pads and wedges to support and secure the panels in place results in a durable decking construction which is very easy to install and remove and thus substantially reduces the inconvenience and cost involved in constructing such decking.

Advantages of the present invention include:

(a) An entire bridge deck can be laid in place in a matter of hours, as opposed to the days, and even weeks previously needed to lay down decking.

(b) The anti-skid surface of the slabs greatly improves the safety factor of a bridge deck as opposed to those surfaces previously in use.

(c) The structure of the concrete slabs is such that they are able to withstand extreme loads, as well as having a projected useful lifetime in excess of fifteen years.

(d) Because of the unique design of the slabs, and wedges, the slabs can be removed, and put back in place easily and quickly for maintenance and inspection of the sub-decking. This is an important improvement over previous decking which generally cannot be removed without actually tearing the surface up, and thereby destroying it.

(e) The slabs are precisely constructed and interchangeable with one another. Thus, those slabs not in the most heavily trafficked area of a bridge deck can be rotated periodically with those receiving little or no traffic, thereby prolonging the life of the bridge deck.

It will be obvious to those skilled in the art that various changes may be made without departing from the scope of the invention and the invention is not considered limited to what is shown in the drawings and described in the specification.

What is claimed is:

1. A reinforced concrete panel, comprising:

a metallic frame having opposite, longitudinally extending sides and opposite ends;

longitudinally projecting tongue means on the opposite ends of the panel, for supporting the panel on a supporting surface;

said frame being substantially filled with reinforced concrete; and a thin, abrasive layer bonded on top of the concrete, said abrasive layer defining an anti-skid surface, and being formed of a calcined bauxite mix and thus substantially increasing the strength of the concrete panel.

2. A panel as in claim 1, wherein a steel reinforcing cage is in the concrete, extending substantially over the entire frame.

3. A panel as in claim 2, wherein the reinforcing cage comprises two substantially identical halves disposed in side-by-side relation in the panel.

4. A panel as in claim 2, wherein the tongue means comprises a pair of laterally spaced apart tongues at each end of the panel, said concrete filling the tongues and comprising a continuous mass with the concrete in the panel.

5. A panel as in claim 4, wherein the panel is generally rectangularly shaped, and has substantially flat, straight sides; and the frame is torsionally reinforced by a plurality of diagonally extending braces secured at their opposite ends in the corners of the frame.

6. Deck structure for bridges or the like, comprising:

deck support means comprising a sub-decking;

a plurality of parallel, spaced apart rails extending across the deck and secured on the deck support means, said rails each having laterally projecting foot flanges and a laterally enlarged head;

a plurality of deck panels spanning the distance between adjacent rails and supported on said rails;

resilient bearing pads engaged between the panels and the foot flanges of the rails to resiliently support the panels on the rails; and resilient locking wedges engaged between the panels and the head of the rails to retain the panels in place on the rails, said resilient bearing pads and locking wedges comprising the only connection between the panels and rails.

7. Deck structure as in claim 6, wherein:

the deck panels comprise reinforced concrete panels having protruding tongue means at the opposite ends thereof, said tongue means being engaged and supported on the resilient bearing pads, and the resilient locking wedges being engaged between the tongue means and the head of the rails.

8. Deck structure as in claim 7, wherein:

the deck panels each comprise a metal frame with sidewalls and opposite ends; and the tongue means comprise a pair of spaced apart tongues on each end of each panel.

9. Deck structure as claim 8, wherein:

each bearing pad has a length substantially equal to the width of each tongue, and the bearing pads are spaced from one another and are engaged only beneath the tongues;

said locking wedges being disposed in end-to-end contiguous relationship.

10. Deck structure as in claim 8, wherein:

the deck panels are generally rectangular in configuration, and have opposite, longitudinally extending metal sidewalls, the adjacent sidewalls of adjacent panels being in flat, metal-to-metal engagement with one another.

11. Deck structure as in claim 6, wherein:

the deck panels comprise reinforced concrete panels having a thin, abrasive layer bonded on the top surface thereof to define an anti-skid surface.

12. Deck structure as in claim 11, wherein:

the abrasive layer comprises a calcined bauxite mix and is thus salt resistant, and also substantially increases the strength of the concrete panel.

13. Deck structure as in claim 9, wherein:

a thin abrasive layer of calcined bauxite mix is bonded on the top surface of the concrete to define an anti-skid surface and to make the panel resistant to road salt and the like and to increase the strength of the concrete panel.

14. Deck structure as in claim 6, wherein:

the resilient bearing pads and resilient locking wedges comprise rubber.

15. Deck structure as in claim 12, wherein the calcined bauxite mix comprises 3.7 parts of bauxite and sand to one part cement, 0.58 parts of water to one part of cement and 17 parts of bauxite to 3 parts of sand, said bauxite having a particle size ranging from dust to a size capable of passing through ¼ inch mesh, said calcined bauxite layer having a thickness of approximately ¾ of an inch, the relative proportions of said bauxite mix being variable within plus or minus about 5% of said proportions.

16. The method of constructing a deck structure for bridges or the like, comprising the steps of:

providing a plurality of substantially identical deck panels;

securing a plurality of parallel, spaced apart rails each having laterally projecting foot flanges and a laterally enlarged head, on a sub-decking;

placing resilient bearing pad means on the foot flanges of the rails;

placing the panels to span the distance between adjacent rails with opposite ends thereof resting on the resilient bearing pads; and inserting resilient locking means between the head of the rails and the ends of the panels to secure the panels in place.

17. The method as in claim 15, including the step of interchanging one panel with another, by removing the locking means to release the panels, lifting the panels from between the rails, and replacing each panel in the place of the other.

18. Deck structure for bridges or the like as in claim 6, wherein said deck panels each comprise a metallic frame having opposite, longitudinally extending sides and opposite ends; longitudinally projecting tongue means on the opposite ends of the panel, for supporting the panel between said adjacent rails; said frame being substantially filled with reinforced concrete, the reinforcing for said concrete comprising a steel reinforcing cage extending substantially over the entire frame, said frame being torsionally reinforced by a plurality of diagonally extending braces secured at their opposite ends in the corners of the frame.

* * * * *